US012516838B2

(12) United States Patent
Ganesan et al.

(10) Patent No.: US 12,516,838 B2
(45) Date of Patent: Jan. 6, 2026

(54) DETECTING AIRFLOW AND TEMPERATURE CONDITIONS OF A FIRE SENSING DEVICE

(71) Applicant: Honeywell International Inc., Charlotte, NC (US)

(72) Inventors: Kamal Raja Ganesan, Chennai (IN); K Ganesh, Andalpuram (IN); Vardhaman Babu Jarale, Bengaluru (IN); Benjamin H. Wolf, Leicester (GB); Michael Barson, Nuneaton (GB)

(73) Assignee: Honeywell International Inc., Charlotte, NC (US)

( * ) Notice: Subject to any disclaimer, the term of this patent is extended or adjusted under 35 U.S.C. 154(b) by 479 days.

(21) Appl. No.: 17/988,121

(22) Filed: Nov. 16, 2022

(65) Prior Publication Data

US 2024/0159410 A1 May 16, 2024

(51) Int. Cl.

| | |
|---|---|
| ***F24F 11/33*** | (2018.01) |
| ***F24F 11/49*** | (2018.01) |
| ***F24F 110/10*** | (2018.01) |
| ***F24F 110/30*** | (2018.01) |
| ***F24F 110/64*** | (2018.01) |
| ***F24F 110/72*** | (2018.01) |

(52) U.S. Cl.

CPC ..... *F24F 11/33* (2018.01); *F24F 11/49* (2018.01); *F24F 2110/10* (2018.01); *F24F 2110/30* (2018.01); *F24F 2110/64* (2018.01); *F24F 2110/72* (2018.01)

(58) Field of Classification Search

CPC ..... B24B 41/042; G01M 1/36

See application file for complete search history.

(56) References Cited

U.S. PATENT DOCUMENTS

| | | | | |
|---|---|---|---|---|
| 6,118,381 | A | 9/2000 | James | |
| 6,917,296 | B2 | 7/2005 | Mayusumi et al. | |
| 7,804,402 | B2 | 9/2010 | Lang et al. | |
| 9,058,731 | B2 | 6/2015 | Andrews et al. | |
| 11,024,154 | B1 | 6/2021 | Lang et al. | |
| 11,132,891 | B2 | 9/2021 | Dearden et al. | |
| 11,725,991 | B1 * | 8/2023 | Moy | G01K 19/00 374/1 |
| 2016/0104358 | A1 * | 4/2016 | Meier | G08B 29/22 340/628 |
| 2016/0363470 | A1 * | 12/2016 | Horng | F24F 11/52 |
| 2017/0045389 | A1 * | 2/2017 | Wolgamott | F24F 13/02 |
| 2017/0263110 | A1 * | 9/2017 | O'Connell | G01D 1/18 |

(Continued)

FOREIGN PATENT DOCUMENTS

| | | |
|---|---|---|
| CN | 110751817 A | 2/2020 |
| EP | 0365047 | 4/1990 |

(Continued)

*Primary Examiner* — Tameem D Siddiquee

(74) *Attorney, Agent, or Firm* — Brooks, Cameron & Huebsch, PLLC

(57) ABSTRACT

Devices, methods, and systems for detecting airflow and temperature conditions of a fire sensing device are described herein. One device includes an airflow sensor and a controller configured to receive a measurement from the airflow sensor, compare the measurement to a baseline range, and transmit a message responsive to the measurement being outside of the baseline range.

19 Claims, 7 Drawing Sheets

(56) References Cited

U.S. PATENT DOCUMENTS

| | | | | |
|---|---|---|---|---|
| 2018/0025599 | A1* | 1/2018 | Herman | G08B 13/19602 348/155 |
| 2018/0038609 | A1* | 2/2018 | Kuroiwa | F24F 11/49 |
| 2021/0065536 | A1* | 3/2021 | Dearden | G08B 17/10 |
| 2021/0248901 | A1* | 8/2021 | Lang | G08B 29/24 |
| 2022/0034540 | A1* | 2/2022 | Reeves | F24F 11/89 |
| 2022/0058929 | A1 | 2/2022 | Dearden et al. | |

FOREIGN PATENT DOCUMENTS

| | | |
|---|---|---|
| EP | 3792890 | 3/2021 |
| EP | 3945510 | 2/2022 |
| WO | 2008016394 | 2/2008 |

* cited by examiner

DETECTING AIRFLOW AND TEMPERATURE CONDITIONS OF A FIRE SENSING DEVICE

TECHNICAL FIELD

The present disclosure relates generally to devices, methods, and systems for detecting airflow and temperature conditions of a fire sensing device.

BACKGROUND

Large facilities, such as commercial buildings, office buildings, hospitals, and the like, as well as residential buildings, such as apartments, townhomes, single family homes, and the like may have a fire alarm system that can be triggered during an emergency situation (e.g., a fire) to warn occupants to evacuate. For example, a fire alarm system may include a fire control panel and a plurality of fire sensing devices (e.g., smoke detectors), located throughout the building (e.g., on different floors and/or in different rooms of the building) that can sense a fire occurring in the building (e.g., by detecting smoke) and provide a notification of the fire to the occupants of the building via alarms.

In some cases, however, smoke can be diverted from entering a fire sensing device and/or diluted before entering the fire sensing device. For example, smoke can be diverted and/or diluted due to an external airflow, an open window, an open door, a fan, an air conditioner, and/or a heating, ventilation, and air conditioning (HVAC) system. As such, the detection of smoke, fire, and/or carbon monoxide by the fire sensing device can be delayed or missed, allowing smoke, fire, and/or carbon monoxide to accumulate and/or spread, which could result in loss of life and/or property.

DETAILED DESCRIPTION

Figure 1:
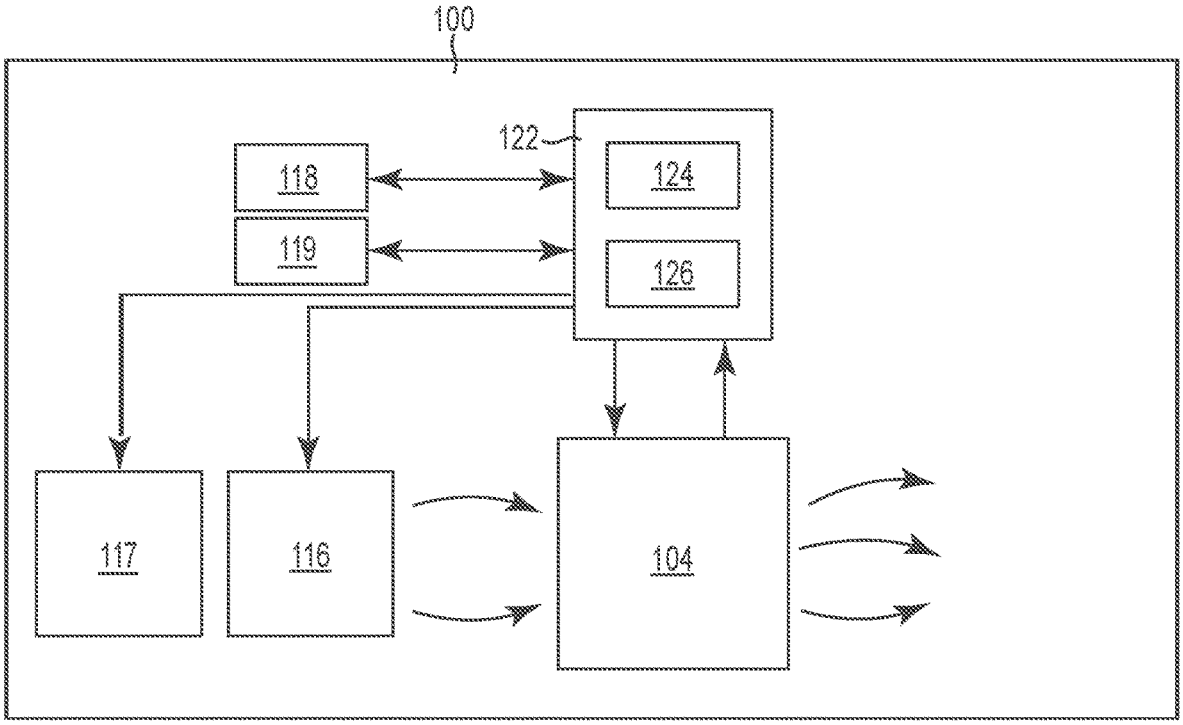
FIG. 1 illustrates a block diagram of a fire sensing device in accordance with an embodiment of the present disclosure.

Devices, methods, and systems for detecting airflow and temperature conditions of a fire sensing device are described herein. One fire sensing device includes an airflow sensor and a controller configured to receive a measurement from the airflow sensor, compare the measurement to a baseline range, and transmit a message responsive to the measurement being outside of the baseline range.

In contrast to previous fire sensing devices in which a person (e.g., maintenance engineer and/or operator) would have to manually inspect whether a fire sensing device was being exposed to an external airflow from an open window or an open door and/or too close to a fan, an air conditioner, and/or an inlet or an outlet of an HVAC system to determine if the device is in danger of delaying or missing detection of smoke, fire, and/or carbon monoxide, a fire sensing device in accordance with the present disclosure can detect airflow and/or temperature conditions of the fire sensing device to determine whether the device is in danger of delaying or missing detection of smoke fire, and/or carbon monoxide. For example, the fire sensing device can utilize an airflow sensor, an air movement device, a particle counter, a pressure sensor, and/or a temperature sensor to determine the airflow and/or temperature to which the fire sensing device is being exposed to determine whether the device is in danger of delaying or missing detection of the smoke, fire, and/or carbon monoxide. Accordingly, fire sensing devices in accordance with the present disclosure may transmit a message, increase their sensitivity to heat, smoke, or carbon monoxide, transmit a command to an HVAC system, determine maintenance and/or relocation is unnecessary, and/or determine maintenance and/or relocation is needed without manual inspection by a person, which can reduce the chance of the fire sensing device delaying or missing the detection of smoke, fire, and/or carbon monoxide.

In the following detailed description, reference is made to the accompanying drawings that form a part hereof. The drawings show by way of illustration how one or more embodiments of the disclosure may be practiced. These embodiments are described in sufficient detail to enable those of ordinary skill in the art to practice one or more embodiments of this disclosure. It is to be understood that other embodiments may be utilized and that mechanical, electrical, and/or process changes may be made without departing from the scope of the present disclosure.

As will be appreciated, elements shown in the various embodiments herein can be added, exchanged, combined, and/or eliminated so as to provide a number of additional embodiments of the present disclosure. The proportion and the relative scale of the elements provided in the figures are intended to illustrate the embodiments of the present disclosure and should not be taken in a limiting sense.

The figures herein follow a numbering convention in which the first digit or digits correspond to the drawing figure number and the remaining digits identify an element or component in the drawing. Similar elements or components between different figures may be identified by the use of similar digits. For example, 104 may reference element "04" in FIG. 1, and a similar element may be referenced as 204 in FIG. 2.

As used herein, "a", "an", or "a number of" something can refer to one or more such things, while "a plurality of" something can refer to more than one such things. For example, "a number of components" can refer to one or more components, while "a plurality of components" can refer to more than one component.

FIG. 1 illustrates a block diagram of a fire sensing device 100 in accordance with an embodiment of the present disclosure. The fire sensing device 100 includes a controller (e.g., microcontroller) 122, a particle counter 104, and an air movement device 116.

The controller 122 can include a memory 124 and a processor 126. Memory 124 can be any type of storage medium that can be accessed by processor 126 to perform various examples of the present disclosure. For example, memory 124 can be a non-transitory computer readable medium having computer readable instructions (e.g., computer program instructions) stored thereon that are executable by processor 126 to detect airflow and temperature conditions of fire sensing device 100 in accordance with the present disclosure. For instance, processor 126 can execute the executable instructions stored in memory 124 to receive a measurement from an airflow sensor, a particle counter 104, or a temperature sensor of fire sensing device 100, compare the measurement to a baseline range, and transmit (e.g., via a network, as will be further described herein) a message and/or command responsive to the measurement being outside of the baseline range. The message and/or command can be transmitted to, for example, a fire control panel, a monitoring device, or a cloud computing device.

The air movement device 116 can be a fan and can rotate in response to the fire sensing device 100 being exposed to a threshold airflow. The controller 122 can detect airflow within the fire sensing device 100 responsive to detecting the rotation of the air movement device 116. Controller 112 can determine maintenance and/or relocation of the fire sensing device 100 is needed responsive to detecting the airflow and transmit a message responsive to determining maintenance and/or relocation of the fire sensing device 100 is needed. In some embodiments, controller 112 can increase the sensitivity level of fire sensing device 100 to heat, smoke, or carbon monoxide responsive to detecting the airflow.

In a number of embodiments, an airflow sensor 118 can be used to detect airflow instead of or in combination with the air movement device 116. The controller 122 can receive a measurement (e.g., an airflow measurement) from the airflow sensor 118 in response to the airflow sensor 118 detecting airflow. In some examples, the airflow sensor 118 can be the air movement device 116, an airflow detector, a volume airflow sensor, a mass airflow sensor, or a pressure sensor.

A temperature sensor 119 can be included in the fire sensing device 100. The temperature sensor 119 can detect a temperature measurement in or around the fire sensing device 100. In a number of embodiments, the temperature sensor 119 can be a thermistor. The controller 122 can receive the measurement (e.g., the temperature measurement) from the temperature sensor 119.

In some examples, the controller 122 can compare the measurement received from the airflow sensor 118 and/or the temperature sensor 119 to a baseline range (e.g., to determine whether the measurement is within the baseline range) and transmit a message responsive to the measurement being outside of the baseline range. For example, controller 112 can compare the airflow measurement to a baseline airflow and transmit the message if the airflow measurement exceeds the baseline airflow. As an additional example, controller 112 can compare the temperature measurement to a baseline temperature range and transmit the message if the temperature measurement is outside the baseline temperature range. In some embodiments, controller 112 can increase the sensitivity of the fire sensing device 100 to heat, smoke, or carbon monoxide responsive to the measurement being outside of the baseline range.

The fire sensing device 100 can further include a particle generator 117 to generate particles. The controller 122 can cause the particle generator 117 to generate particles and can receive a measurement from the particle counter 104 after causing the particle generator 117 to generate the particles. In some examples, the particle counter 104 can be an optical scatter chamber that can measure a quantity of particles therein. The controller 122 can compare the measurement received from the particle counter 104 to a baseline particle range (e.g., to determine whether the quantity of particles is outside the baseline particle range) and can transmit a message responsive to the measurement received from the particle counter 104 being outside the baseline particle range.

The memory 124 can store the baseline range of particles, airflow, and/or temperature, a measured quantity of particles, airflow, and/or temperature, and/or a different measured quantity of particles, airflow, and/or temperature. In some examples, controller 122 can receive the baseline range and store the received baseline range in the memory 124. In some examples, the measured quantity can be stored in memory 124 as a baseline quantity of particles, airflow, and/or temperature if, for example, the measured quantity of particles, airflow, or temperature is the first (e.g., initial) quantity of particles, airflow, or temperature measured by the fire sensing device 100. Controller 122 can then determine the baseline range to which subsequent measurements are compared based on this initial measurement. As an additional example, a subsequently measured airflow can be compared to the baseline airflow.

Figure 2:
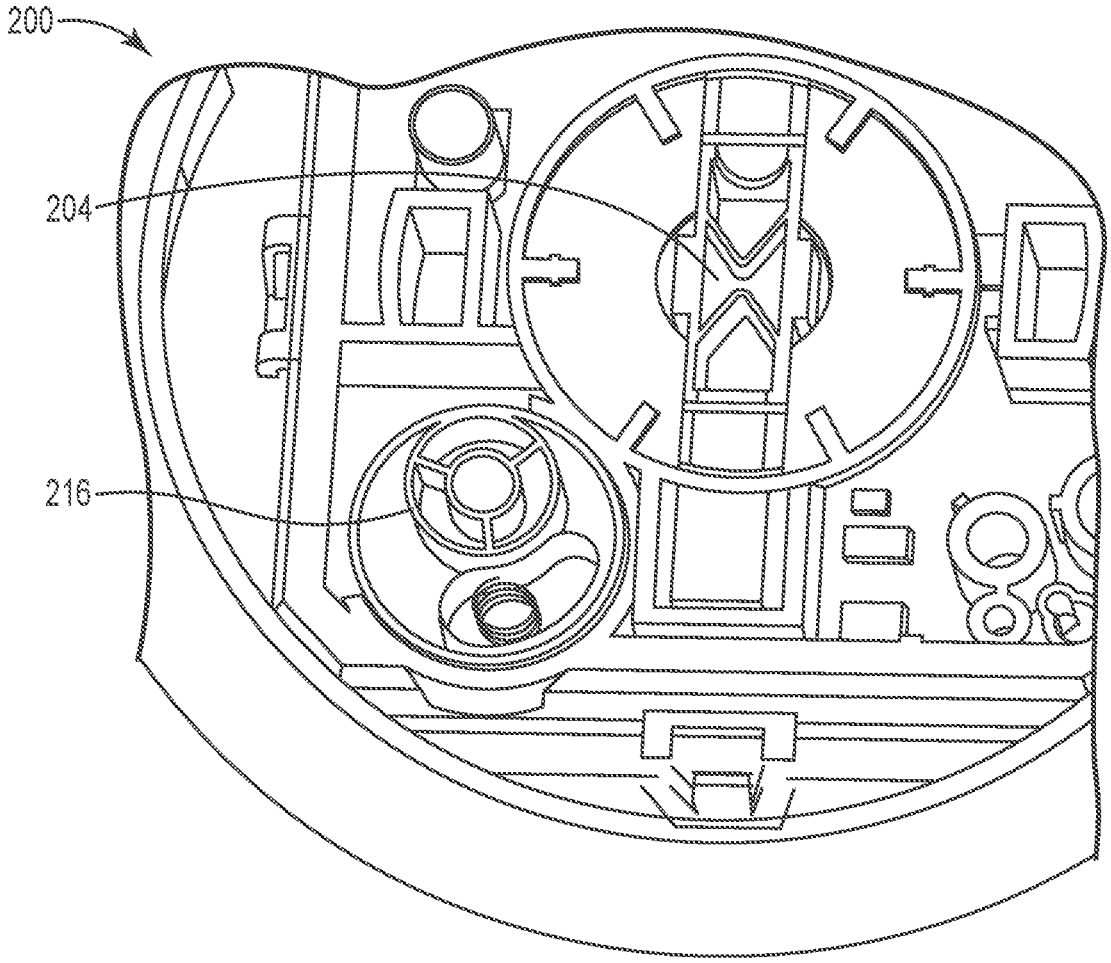
FIG. 2 illustrates a portion of an example of a fire sensing device in accordance with an embodiment of the present disclosure.

FIG. 2 illustrates a portion of an example of a fire sensing device 200 in accordance with an embodiment of the present disclosure. The fire sensing device 200 can correspond to the fire sensing device 100 of FIG. 1 and can be, but is not limited to, a fire and/or smoke detector of a fire control system such as, for instance, self-test detector.

A fire sensing device 200 can sense a fire occurring in a facility and trigger a fire response to provide a notification of the fire to occupants of the facility. A fire response can include visual and/or audio alarms, for example. A fire response can also notify emergency services (e.g., fire departments, police departments, etc.) In some examples, a plurality of fire sensing devices can be located throughout a facility (e.g., on different floors and/or in different rooms of the facility).

As shown in FIG. 2, fire sensing device 200 can include a particle counter 204 illustrated as an optical scatter chamber and an air movement device 216, which can correspond to the particle counter 104 and the air movement device 116 of FIG. 1, respectively. Although the air movement device 216 is illustrated as a fan in FIG. 2, any device capable of sensing airflow can be used. For example, an airflow detector, a volume airflow sensor, a mass airflow sensor, or a pressure sensor could be used instead of and/or in combination with a fan as the air movement device 216.

The air movement device 216 can also control the airflow through the fire sensing device 200, including the optical scatter chamber. For example, the air movement device 216 can move particles, gases, and/or aerosol from a first end of the fire sensing device 200 to a second end of the fire sensing device 200. The air movement device 216 can start responsive to a command and can stop responsive to a command and/or after a particular period of time.

A fire sensing device 200 can automatically, or upon receipt of a command, detect particles. The particle counter 204 can measure a quantity of particles in the optical scatter chamber. The fire sensing device 200 can compare the measured quantity of particles to a baseline range and transmit a message responsive to the measurement being outside the baseline range.

Figure 3:
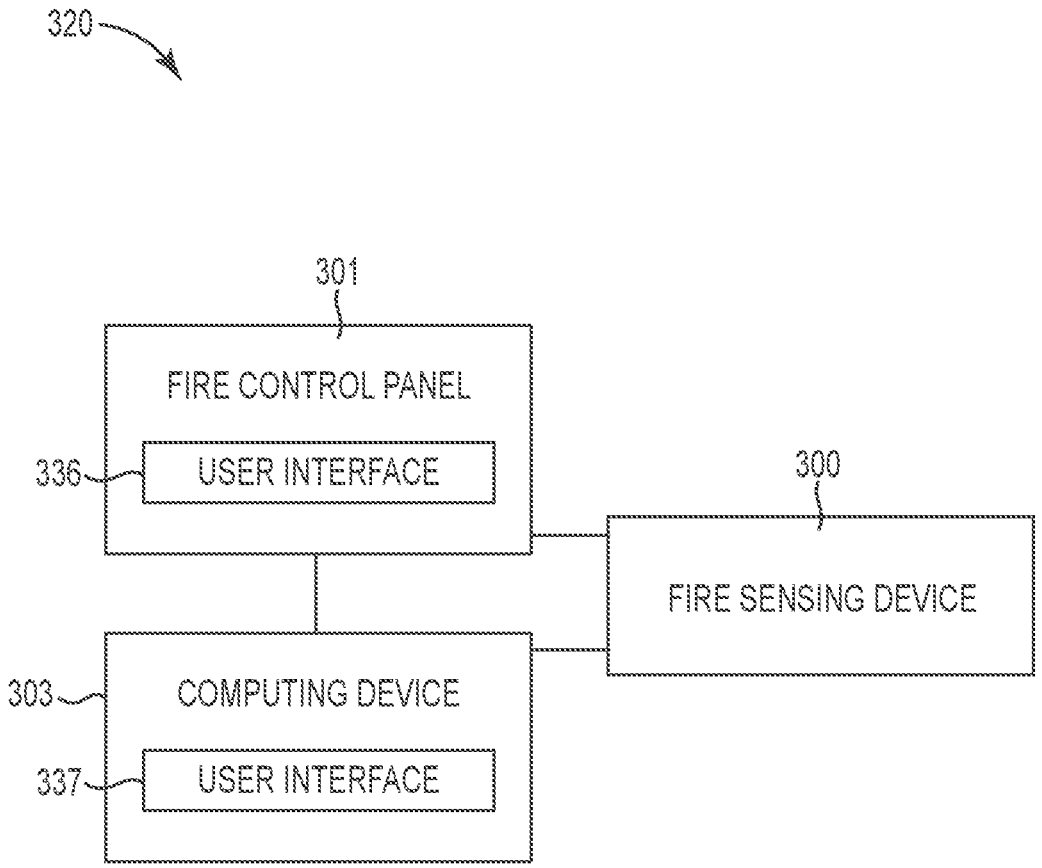
FIG. 3 illustrates a block diagram of a fire alarm system in accordance with an embodiment of the present disclosure.

FIG. 3 illustrates a block diagram of a fire alarm system 320 in accordance with an embodiment of the present disclosure. The fire alarm system 320 can include a fire sensing device 300, a fire control panel 301, and a computing device 303. Fire sensing device 300 can be, for example, fire sensing device 100 and/or 200 previously described in connection with FIGS. 1 and 2, respectively. Further, although a single fire sensing device 300 is illustrated in FIG. 3 for simplicity and so as not to obscure embodiments of the present disclosure, fire alarm system 320 can include a plurality of fire sensing devices analogous to fire sensing device 300.

The fire control panel 301 can be a monitoring device, a fire detection control system, and/or a cloud computing device of the fire alarm system 320. The fire control panel 301 can be configured to send commands to and/or receive messages from a fire sensing device 300 via a wired or wireless network (not shown in FIG. 3 for simplicity and so as not to obscure embodiments of the present disclosure). For example, the fire sensing device 300 can transmit a message to the fire control panel 301 responsive to a measurement by the fire sensing device 300 being outside a baseline range, as previously described herein. Such a message can, for example, direct a technician to move the fire sensing device 300. The fire control panel 301 can receive messages from, a number of fire sensing devices analogous to fire sensing device 300. For example, the fire control panel 301 can receive messages from each of a number of fire sensing devices analogous to fire sensing device 300 and store data based on the messages from each of the number of fire sensing devices.

In a number of embodiments, the fire control panel 301 can include a user interface 336. The user interface 336 can be a graphical user interface (GUI) that can provide and/or receive information to and/or from a user and/or the fire sensing device 300. The user interface 336 can display messages and/or data received from the fire sensing device 300. For example, the user interface 336 can display a message indicating fire sensing device 300 needs maintenance and/or relocation, direct a technician to move the fire sensing device 300, direct a technician to increase a sensitivity of the fire sensing device 300 to heat, smoke, and/or carbon monoxide, and/or transmit a command to an HVAC system.

The networks described herein can be a network relationship through which fire sensing device 300 and/or fire control panel 301 can communicate with each other. Examples of such a network relationship can include a distributed computing environment (e.g., a cloud computing environment), a wide area network (WAN) such as the Internet, a local area network (LAN), a personal area network (PAN), a campus area network (CAN), or metropolitan area network (MAN), among other types of network relationships. For instance, the network can include a number of servers that receive information from and transmit information to fire sensing device 300 and/or fire control panel 301 via a wired or wireless network.

As used herein, a "network" can provide a communication system that directly or indirectly links two or more computers and/or peripheral devices and allows a fire control panel 301 to access data and/or resources on a fire sensing device 300 and vice versa. A network can allow users to share resources on their own systems with other network users and to access information on centrally located systems or on systems that are located at remote locations. For example, a network can tie a number of computing devices together to form a distributed control network (e.g., cloud).

A network may provide connections to the Internet and/or to the networks of other entities (e.g., organizations, institutions, etc.). Users may interact with network-enabled software applications to make a network request, such as to get data. Applications may also communicate with network management software, which can interact with network hardware to transmit information between devices on the network.

In some examples, the network can be used by the fire sensing device 300 and/or the fire control panel 301 to communicate with a computing device 303. The computing device 303 can be a personal laptop computer, a desktop computer, a mobile device such as a smart phone, a tablet, a wrist-worn device, and/or redundant combinations thereof, among other types of computing devices. The computing device 303 can receive messages from a number of fire sensing devices analogous to fire sensing device 300 and/or a number of fire control panels analogous to fire control panel 301 and transmit commands based on the messages to one or more of the number of fire sensing devices and/or one or more of the number of fire control panels. For example, the fire sensing device 300 can transmit a message that maintenance and/or relocation of the fire sensing device 300 is needed to the computing device 303 responsive to a measurement from an airflow sensor being outside of a baseline range, a measurement from a particle counter being outside a baseline range, detecting airflow within the fire sensing device 300, and/or a measurement from a temperature sensor being outside of a baseline range.

In a number of embodiments, the computing device 303 can include a user interface 337. The user interface 337 can be a GUI that can provide and/or receive information to and/or from a user, the fire sensing device 300 and/or the fire control panel 301. The user interface 337 can display messages and/or data received from the fire sensing device 300 and/or the fire control panel 301. For example, the user interface 337 can display a fire sensing device 300 needing maintenance and/or relocation, direct a technician to move the fire sensing device 300, direct a technician to increase a sensitivity of the fire sensing device 300 to heat, smoke, and/or carbon monoxide, and/or transmit a command to an HVAC system.

Figure 4:
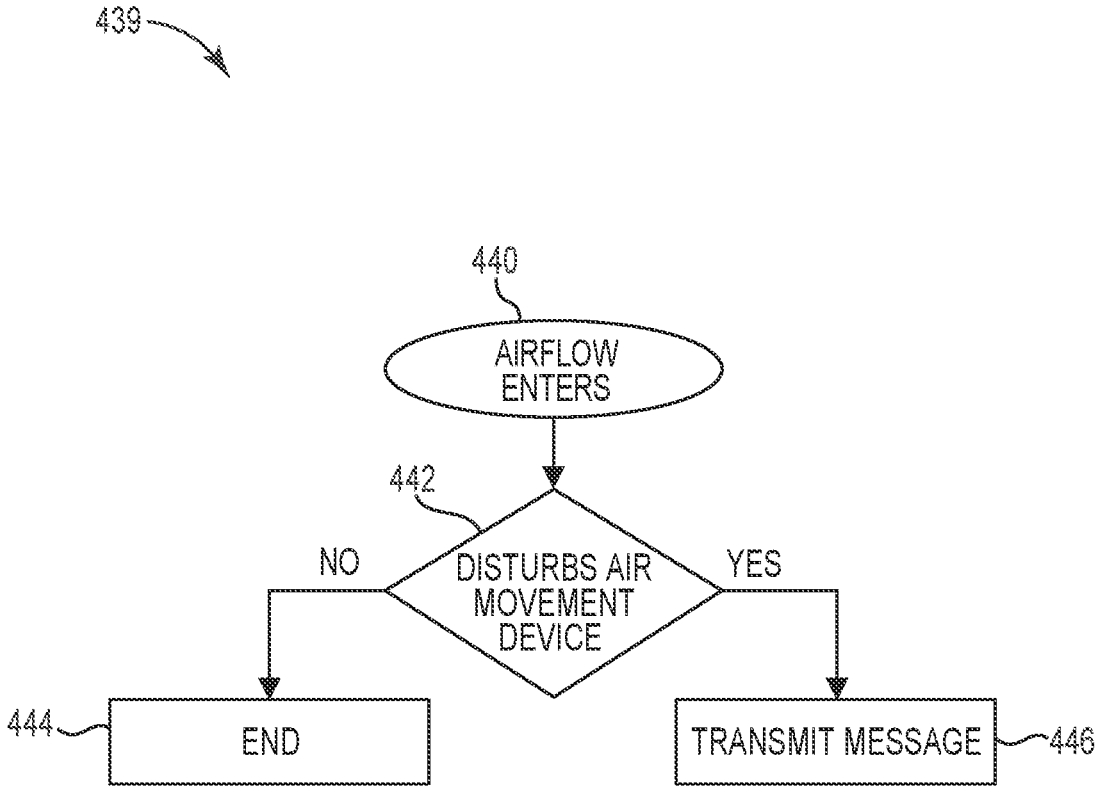
FIG. 4 illustrates a method flow diagram of an airflow detection function of a fire sensing device in accordance with an embodiment of the present disclosure.

FIG. 4 illustrates a method flow diagram 439 of an airflow detection function of a fire sensing device in accordance with an embodiment of the present disclosure. In some embodiments, the method illustrated in FIG. 4 can be performed by the fire sensing device previously described in connection with FIGS. 1, 2, and/or 3.

At block 440, airflow enters the fire sensing device, and it is determined whether the airflow disturbs an air movement device (e.g., air movement device 116 and 216 of FIGS. 1 and 2, respectively) of the fire sensing device at block 442. In some examples, the air movement device can be a fan, and the disturbance of the air movement device can be a rotation of the fan. The air movement device can rotate in response to any airflow entering the fire sensing device, or responsive to a threshold amount of airflow entering the fire sensing device. For example, the fan may be of a certain size, weight, and/or form such that only a threshold amount of airflow may cause it to rotate.

If the air movement device is not disturbed, the method can end at block 444. For example, the airflow detection process can end at block 444 if rotation of the air movement device is not detected. If the air movement device is disturbed, the fire sensing device can transmit a message at block 446. For example, the fire sensing device can transmit the message at 446 if rotation of the air movement device is detected. Airflow can be detected within the fire sensing device responsive to detecting the rotation of the air movement device. In some examples, the airflow can be determined based on revolutions per minute of the air movement device.

Figure 5:
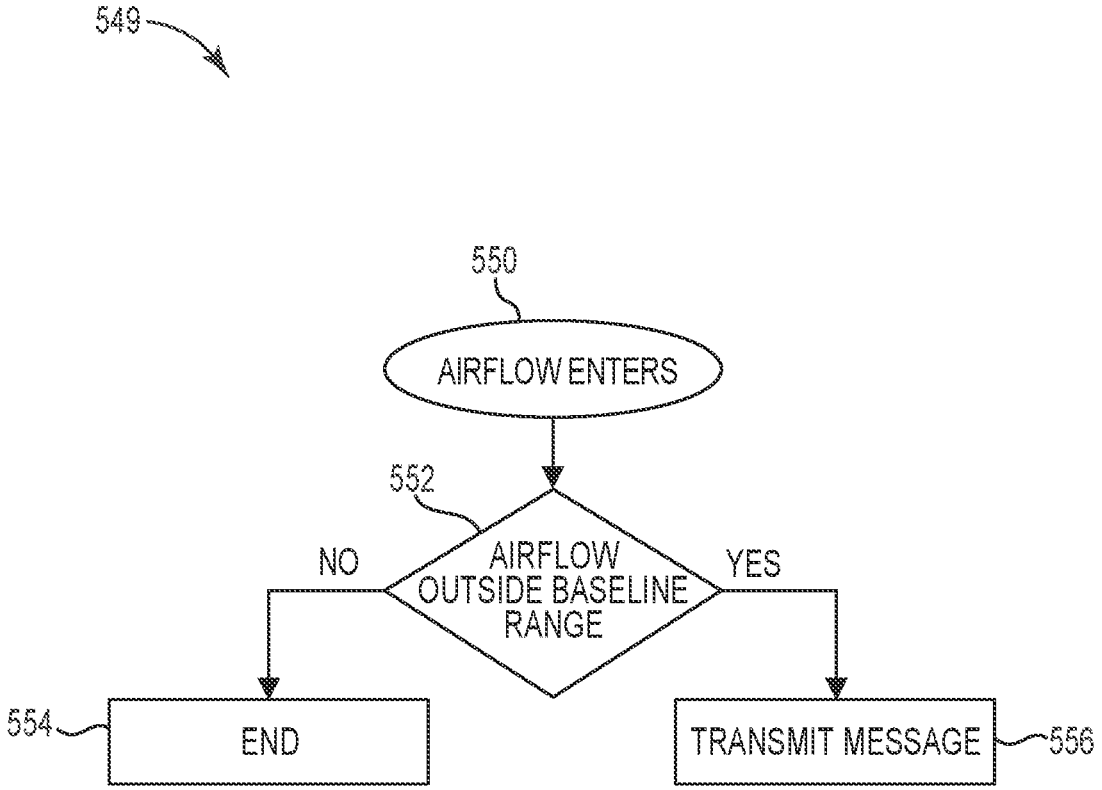
FIG. 5 illustrates a method flow diagram of an airflow detection function of a fire sensing device in accordance with an embodiment of the present disclosure.

FIG. 5 illustrates a method flow diagram 549 of an airflow detection function of a fire sensing device (e.g., fire sensing device 100, 200, and 300 of FIGS. 1, 2, and 3, respectively) in accordance with an embodiment of the present disclosure.

At block 550, airflow can enter the fire sensing device, and it is determined whether the airflow is outside a baseline range at block 552. For instance, an airflow sensor (e.g., airflow sensor 118 of FIG. 1) can be included in or coupled to the fire sensing device. In some examples, the airflow sensor can be an airflow detector, volume airflow sensor, a mass airflow sensor, or a pressure sensor. The airflow sensor can measure airflow inside or just outside of the fire sensing device and transmit the measurement to a controller (e.g., controller 122 of FIG. 1) of the fire sensing device.

The controller can compare the measurement to a baseline range. The baseline range can be or be based on a previous measurement received at the controller from the airflow sensor, another fire sensing device, a fire control panel, a monitoring device, and/or a cloud computing device. The controller can store the baseline range in memory (e.g., memory 124 in FIG. 1).

If the airflow is not outside of the baseline range, the method can end at block 554. If the airflow is outside the baseline range, the fire sensing device can transmit a message at block 556. The message can be transmitted to another fire sensing device, a fire control panel, a monitoring device, and/or a cloud computing device. In a number of embodiments, the controller can determine the fire sensing device needs maintenance and/or relocation, increase a sensitivity of the fire sensing device to heat, smoke, or carbon monoxide, and/or transmit a command to an HVAC system responsive to the measurement being outside of the baseline range, detecting airflow, and/or the airflow exceeding a baseline airflow.

In a number of embodiments, airflow can be detected in an additional fire sensing device. The additional fire sensing device can determine whether maintenance and/or relocation is necessary or unnecessary responsive to the airflow in an analogous manner. The airflow measurement of the fire sensing device and the additional fire sensing device can be used to determine a direction of airflow within the fire sensing device. The direction of the airflow can be included in the transmitted message.

Figure 6:
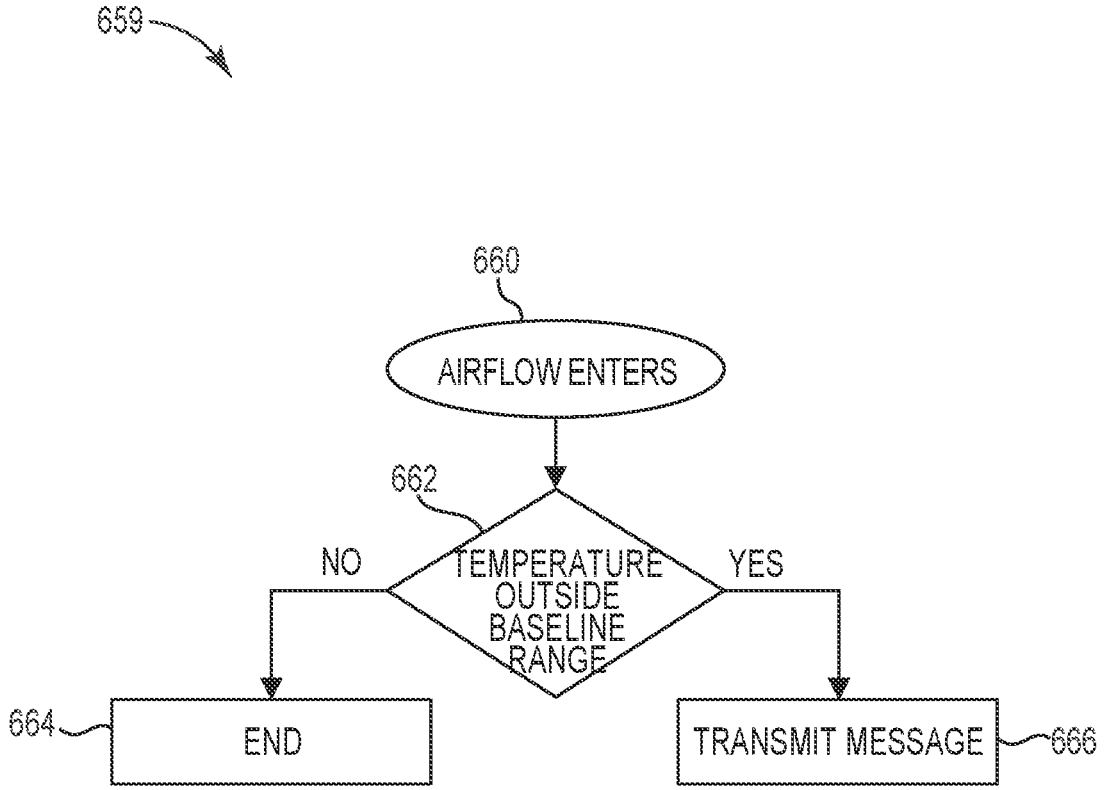
FIG. 6 illustrates a method flow diagram of a temperature detection function of a fire sensing device in accordance with an embodiment of the present disclosure.

FIG. 6 illustrates a method flow diagram 659 of a temperature detection function of a fire sensing device (e.g., fire sensing device 100, 200, and 300 of FIGS. 1, 2, and 3, respectively) in accordance with an embodiment of the present disclosure.

At block 660, airflow can enter the fire sensing device, and it is determined whether the temperature of the air is outside a baseline range at block 662. The temperature can be measured by a temperature sensor, for example, a thermistor. In a number of embodiments, the baseline range can be received at and/or stored by the fire sensing device.

If the temperature is not outside the baseline range, the method can end at block 664. If the temperature is outside the baseline range, the fire sensing device can transmit a message at block 666. The message can be transmitted to a fire control panel, a monitoring device, or a cloud computing device, for example. In a number of embodiments, the message can direct a technician to move the fire sensing device.

Figure 7:
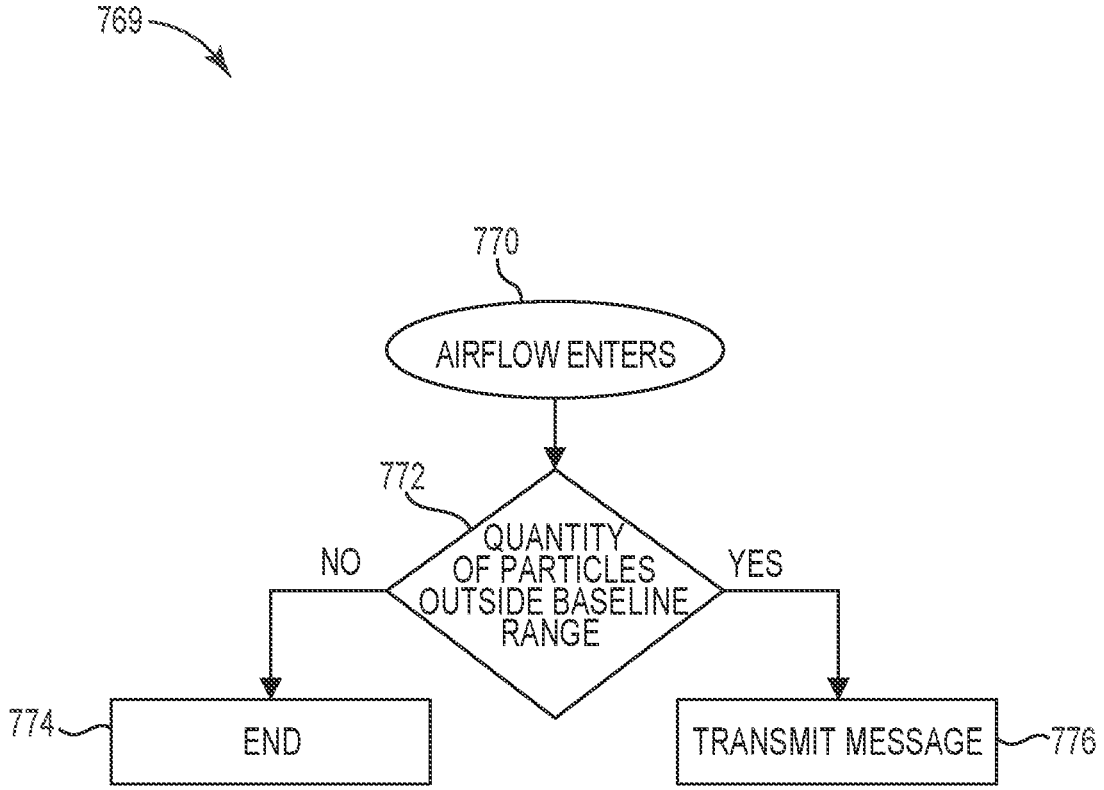
FIG. 7 illustrates a method flow diagram of a particle detection function of a fire sensing device in accordance with an embodiment of the present disclosure.

FIG. 7 illustrates a method flow diagram 769 of a particle detection function of a fire sensing device (e.g., fire sensing device 100, 200, and 300 in FIGS. 1, 2, and 3, respectively) in accordance with an embodiment of the present disclosure.

At block 770, airflow can enter the fire sensing device, and it is determined whether a quantity of particles in the fire sensing device is outside a baseline range at block 772. The quantity of particles can be measured by a particle counter (e.g., particle counter 104 and 204 of FIGS. 1 and 2, respectively. In some examples, a particle generator (e.g., particle generator 117 of FIG. 1) can generate the particles prior to measuring the quantity of particles at the particle counter.

If the quantity of particles is not outside the baseline range, the method can end at block 774. If the quantity of particles is outside the baseline range, the fire sensing device can transmit a message at 776. The message can be transmitted to a fire control panel, a monitoring device, or a cloud computing device, for example. In a number of embodiments, the message can direct a technician to move the fire sensing device.

Although specific embodiments have been illustrated and described herein, those of ordinary skill in the art will appreciate that any arrangement calculated to achieve the same techniques can be substituted for the specific embodiments shown. This disclosure is intended to cover any and all adaptations or variations of various embodiments of the disclosure.

It is to be understood that the above description has been made in an illustrative fashion, and not a restrictive one. Combination of the above embodiments, and other embodiments not specifically described herein will be apparent to those of skill in the art upon reviewing the above description.

The scope of the various embodiments of the disclosure includes any other applications in which the above structures and methods are used. Therefore, the scope of various embodiments of the disclosure should be determined with reference to the appended claims, along with the full range of equivalents to which such claims are entitled.

In the foregoing Detailed Description, various features are grouped together in example embodiments illustrated in the figures for the purpose of streamlining the disclosure. This method of disclosure is not to be interpreted as reflecting an intention that the embodiments of the disclosure require more features than are expressly recited in each claim.

Rather, as the following claims reflect, inventive subject matter lies in less than all features of a single disclosed embodiment. Thus, the following claims are hereby incorporated into the Detailed Description, with each claim standing on its own as a separate embodiment.

What is claimed is:

1. A fire sensing device, comprising:

an airflow sensor; and a controller configured to:

receive a measurement of airflow from the airflow sensor;

compare the airflow measurement to a baseline airflow;

determine relocation is needed responsive to the airflow measurement exceeding the baseline airflow; and transmit a message to a fire control panel to direct a technician to move the fire sensing device, wherein the technician relocates the fire sensing device.

2. The device of claim 1, wherein the controller is configured to increase a sensitivity of the fire sensing device to heat, smoke, or carbon monoxide responsive to-the airflow measurement exceeding the baseline airflow.

3. The device of claim 1, wherein the airflow sensor is an air movement device or an airflow detector.

4. The device of claim 1, further comprising a particle generator and a particle counter.

5. The device of claim 4, wherein the controller is configured to:

cause the particle generator to generate particles;

receive a measurement from the particle counter after causing the particle generator to generate the particles;

compare the measurement received from the particle counter to an additional baseline range; and transmit the message responsive to the measurement received from the particle counter being outside the additional baseline range.

6. The device of claim 1, wherein the controller is configured to receive a previous measurement from the airflow sensor, wherein the baseline airflow is based on the previous measurement.

7. The device of claim 1, wherein the controller is configured to transmit a command to a heating, ventilation, and air conditioning (HVAC) system responsive to the airflow measurement exceeding the baseline airflow.

8. A method of operating a fire sensing device, comprising:

detecting airflow within the fire sensing device;

determining relocation of the fire sensing device is needed responsive to the airflow exceeding a baseline airflow;

transmitting a message to a fire control panel to direct a technician to move the fire sensing device responsive to determining relocation of the fire sensing device is needed; and relocating the fire sensing device.

9. The method of claim 8, further comprising:

detecting rotation of an air movement device; and detecting the airflow within the fire sensing device responsive to detecting the rotation of the air movement device.

10. The method of claim 8, wherein the method includes detecting the airflow via a volume airflow sensor, a mass airflow sensor, or a pressure sensor.

11. The method of claim 8, further comprising increasing a sensitivity level of the fire sensing device to heat, smoke, or carbon monoxide responsive to detecting the airflow.

12. The method of claim 8, further comprising:

detecting the baseline airflow within the fire sensing device prior to detecting the airflow; and comparing the airflow to the baseline airflow.

13. The method of claim 8, further comprising:

detecting airflow within an additional fire sensing device; and determining maintenance or relocation of the additional fire sensing device is not needed responsive to detecting the airflow within the additional fire sensing device.

14. The method of claim 13, further comprising determining a direction of airflow within the fire sensing device based on the detected airflow within the fire sensing device and the detected airflow within the additional fire sensing device.

15. The method of claim 14, wherein the message includes the direction of the airflow.

16. A fire sensing device, comprising:

a temperature sensor; and a controller configured to:

receive a measurement from the temperature sensor;

compare the measurement from the temperature sensor to a baseline range;

determine relocation is needed responsive to the measurement being outside the baseline range; and transmit a message to a fire control panel to direct a technician to move the fire sensing device, wherein the technician relocates the fire sensing device.

17. The device of claim 16, wherein the controller is configured to transmit the message to a monitoring device or a cloud computing device.

18. The device of claim 16, wherein the controller is configured to:

receive the baseline range; and store the baseline range.

19. The device of claim 16, wherein the temperature sensor is a thermistor.

* * * * *